US005228687A

United States Patent [19]

Luecke et al.

[11] Patent Number: 5,228,687

[45] Date of Patent: Jul. 20, 1993

[54] FOOTBALL WITH GYROSCOPIC RING

[75] Inventors: Mark T. Luecke; Craig C. Williamson, both of North Riverside, Ill.

[73] Assignee: Meyer/Glass Design, Chicago, Ill.

[21] Appl. No.: 1,455

[22] Filed: Jan. 7, 1983

[51] Int. Cl.[5] ..... A63B 41/00

[52] U.S. Cl. ..... 273/65 EC; 273/65 EF; 273/DIG. 20; 40/327

[58] Field of Search ..... 273/65 EC, 65 EF, 65 EG, 273/65 ED, 65 R, DIG. 20, DIG. 8; 40/327

[56] References Cited

U.S. PATENT DOCUMENTS

| | | | |
|---|---|---|---|
| Re. 33,449 | 11/1990 | Martin | 273/65 EE |
| 1,597,308 | 8/1926 | Brandt | 273/65 EC |
| 2,011,760 | 8/1935 | Gallinant | 273/65 EG |
| 2,194,674 | 3/1940 | Riddell | 273/65 EG |
| 2,364,247 | 12/1944 | Shearer | 273/65 EC |
| 2,859,040 | 11/1958 | Gow et al. | 273/65 EG |
| 3,450,407 | 6/1969 | Russo | 273/65 EC |
| 3,700,239 | 10/1972 | Paterick et al. | 273/65 EF X |
| 3,884,466 | 5/1975 | MacDonald et al. | 273/65 EC |
| 4,003,574 | 1/1977 | MacDonald et al. | 273/65 EC |
| 4,248,424 | 2/1981 | Judkins | 273/60 B |
| 4,337,944 | 7/1982 | Massino | 273/65 A |
| 4,772,020 | 9/1988 | Martin | 273/65 EE |
| 4,917,381 | 4/1990 | Spector | 273/58 H |
| 5,000,451 | 3/1991 | MacDonald et al. | 273/65 EC |
| 5,020,438 | 6/1991 | Brown | 273/58 K X |
| 5,123,645 | 6/1992 | MacDonald et al. | 273/65 EC |
| 5,133,550 | 7/1992 | Handy | 273/65 EE |

*Primary Examiner*—George J. Marlo

[57] ABSTRACT

A football having a body formed of a foam material an oblate spheroid contour being substantially symmetrical about a major axis and a minor axis. An outwardly opening groove is formed in the outer surface of the body and extends circumferentially about the minor axis. A soft, resilient plastic ring is seated in the groove. The ring has a weight in the range of approximately one-third to approximately the weight of the foam body. Shallow dimples are formed on the outer surface of the body with the dimples arranged in a plurality of rows extending along the major axis of the body. Each row has a number of dimples located on a compound curve which passes through a meridian at the minor axis of the body, has loops on opposite sides of the meridian and terminates at the meridian at opposite ends of the body. The diameters of the dimples decrease from the largest diameters located adjacent the minor axis of the body to the smallest diameters adjacent the ends of the body along the major axis.

5 Claims, 1 Drawing Sheet

FOOTBALL WITH GYROSCOPIC RING

BACKGROUND OF THE INVENTION

The common American football whether made with an inflatable bladder and an outer casing of leather or synthetic material or made of a solid foam plastic is difficult to throw for any distance with a high degree of accuracy except for the most experienced players. Accuracy in throwing a football depends, in part, upon the ability of the player to spin or spiral the football when it is thrown. Attempts have been made in the past to overcome the inability of a football to be spiralled by an unskilled thrower by providing ribs and grooves on the outer surface of the football so that the player can more easily grip and impart a spin to the ball when it is thrown. Other approaches in the past have involved installing weights in the football in the form of annular bands, disks, axially extending tubes, and even circumferentially extending tubes containing weights which weights move outwardly by centrifugal force when the football is thrown with a spiral-like spin. In the footballs that were equipped with axially extending weighted tubes, these tubes were usually installed in a longitudinal passage extending through the longitudinal axis of the football. However, none of these modified footballs have gained popular acceptance among the general populace who play football.

SUMMARY OF THE INVENTION

Accordingly, this invention is directed to a football to be used primarily by those engaged in non-regulation play who prefer to use a football of the type having a solid foam body.

It is a primary object of this invention to provide a foam body football that an unskilled player can throw with the accuracy usually attained only by a skilled player.

Another object of this invention is a foam body football that can be thrown a greater distance than the conventional foam body football.

Another object of this invention is a foam body football that can be thrown in a spiral more easily than conventional footballs of the inflated bladder or foam body type.

Another object of this invention is a weighted foam body football that can be kicked and caught without causing injury to the kicker or the receiver.

Another object of this invention is a foam body football having a dimpled surface which enables a player to better grip and throw the ball in a spiral.

Other objects of the invention may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
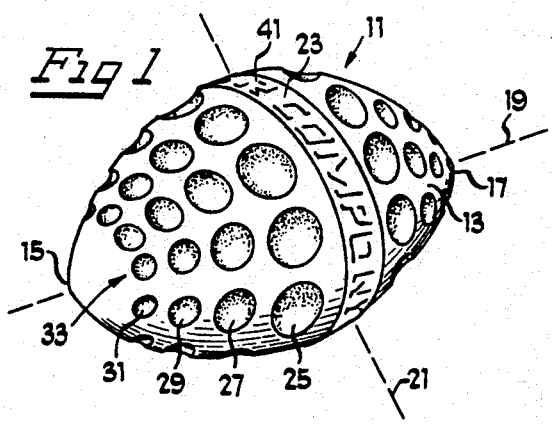
FIG. 1 is a perspective view of a football embodying the novel features of this invention.
Figure 5:
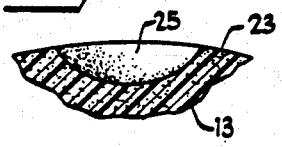
FIG. 5 is an enlarged, partial cross sectional view taken along line 5—5 of FIG. 2.
Figure 2:
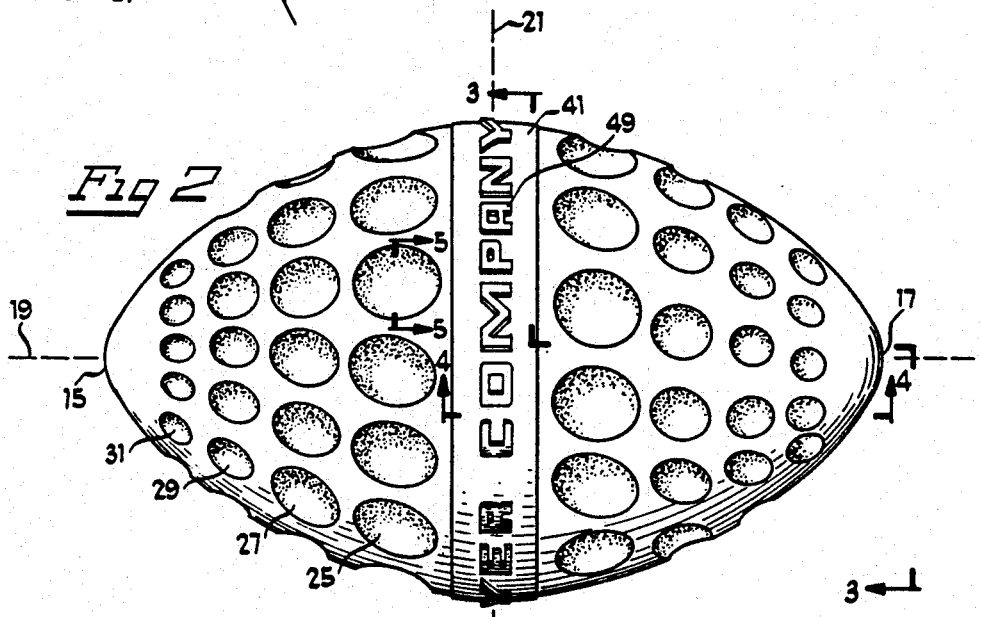
FIG. 2 is an enlarged side elevational view of the football of FIG. 1.
Figure 3:
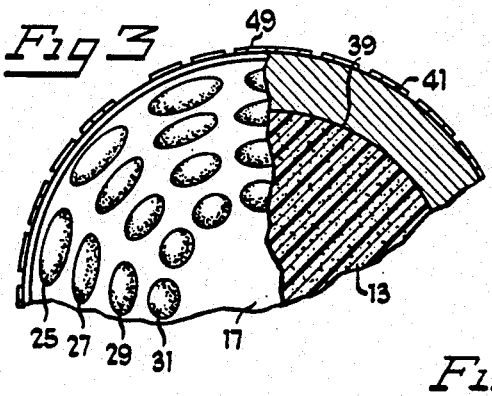
FIG. 3 is a partial front elevational view of the football of FIG. 2, with a portion broken away, and viewed along lines 3—3 of FIG. 2.
Figure 4:
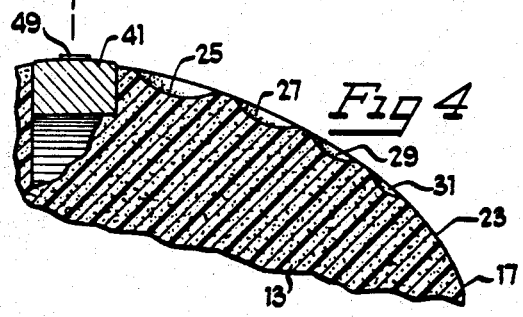
FIG. 4 is an enlarged, partial cross sectional view taken along line 4—4 of FIG. 2.
Figure 6:
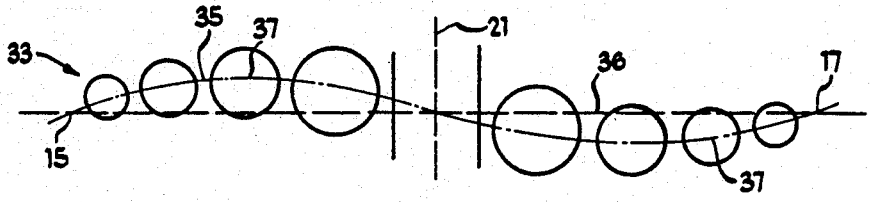
FIG. 6 is a schematic view showing the layout of a typical row of dimples arranged along one of the compound curves on the surface of the football.

FIG. 1 shows a perspective view of the football 11 of this invention which defines an oblate spheroid body 13 preferably formed of a resilient foam material such as plastic, rubber or the like. Polyurethane is the preferred foam material. The body 13 defines generally pointed end portions 15 and 17 aligned along a major axis 19. A minor axis 21 extends through the center of the body at right angles to the major axis 19. The body 13 further includes an outer convex surface 23 that may be self skinned or provided with a surface coating applied to the interior of the mold which forms the body 13. The outer convex surface 23 is covered with dimples 25, 27, 29, and 31 of diminishing diameters arranged in a plurality of rows 33 with each row 33 of dimples located on a compound curve 35 which spirals in relationship to the main axis 19 of the body 13. The compound curve passes through a meridian 36 at the minor axis 21, its loops 37 are positioned on opposite sides of the meridian 36 and the curve terminates at the ends 15 and 17 of the body at the meridian.

A shallow annular groove 39 is formed about the equator of the body aligned with the minor axis 21. Seated in this shallow annular groove is a ring 41 formed of a flexible, resilient material such as a flexible polyvinylchloride. The ring 41 may be adhered to the body 13 of foam material by an adhesive or by the friction of the materials of the ring and body. The ring may also be formed with lettering 49 on the outer surface thereof.

In the preferred embodiment of the invention, the ring 41 is formed with a weight equal to approximately 60 to 65% of the weight of the foam body 13. The weight of the ring can be varied ranging from somewhat less than one-third the weight of the body 13 to approximately the weight of the body 13. The relatively heavy ring 41 provides a stabilizing gyroscopic effect to a thrown football and also provides weight to enable the ball to travel a much greater distance than a football with only a foam body could be thrown or kicked.

To enable player to grip the football and throw it in a spiral to take maximum advantage of the weight of the ring 41, the dimples 25, 27, 29 and 31 are arranged with decreasing diameters and depth extending along each of their compound curves 35 from the dimples of largest diameter located next to the ring 41 to dimples of the smallest diameter located next to the end portions 15 and 17 of the body 13. In addition to providing a gripping surface for the ball thrower, the dimples 25, 27, 29 and 31 also provide a slight amount of friction which stabilizes the football much as dimples on a golf ball stabilize the flight of the golf ball.

Forming the ring 41 of a soft, flexible, resilient material allows the football 11 to be kicked by a player wearing ordinary street shoes without causing injury to the player.

I claim:

1. A ball having a body formed of a foam material with an oblate, spheroid contour being substantially symmetrical about a major axis and a minor axis and adapted to be manually thrown through the air, an outwardly opening groove formed in the outer surface of said body and extending circumferentially about said minor axis, a soft, flexible, resilient ring seated in said groove, and said ring having a weight relative to the weight of said foam body in the range of one-third to approximately the weight of said foam body.

2. The football of claim 1 in which said ring has a weight equal to approximately the weight of said foam body.

3. The football of claim 1 in which said ring has a weight equal to approximately 60–65% of the weight of said foam body.

4. The ball of claim 1 in which dimples are formed on the outer surface of said body with said dimples arranged in a plurality of longitudinally extending rows, each row having a plurality of dimples located on a compound curve, said dimples in each row varying in diameter with dimples of larger diameter located adjacent said minor axis of said body with the diameters of said dimples decreasing in diameter along said major axis in directions away from said minor axis.

5. The football of claim 4 in which said compound curve passes through a meridian at the minor axis of the foam body, has loops on opposite sides of the meridian and terminates at the meridian at opposite ends of the foam body.

* * * * *